US007240707B1

(12) United States Patent
Schweitzer

(10) Patent No.: US 7,240,707 B1
(45) Date of Patent: Jul. 10, 2007

(54) PORTABLE WORK BENCH STATION

(76) Inventor: Russell Lee Schweitzer, 3900 N. Ave. W., Missoula, MT (US) 59804-4627

( * ) Notice: Subject to any disclaimer, the term of this patent is extended or adjusted under 35 U.S.C. 154(b) by 0 days.

(21) Appl. No.: 11/491,661

(22) Filed: Jul. 24, 2006

(51) Int. Cl.
*B25H 1/00* (2006.01)

(52) U.S. Cl. ..... 144/286.5; 248/298.1

(58) Field of Classification Search ..... 144/285–287; 249/298.1; 108/28, 29; 312/280
See application file for complete search history.

(56) References Cited

U.S. PATENT DOCUMENTS 851,292 A * 4/1907 Kapp ..... 269/71
5,082,037 A * 1/1992 Hammons et al. ..... 144/286.5
5,267,748 A * 12/1993 Curran ..... 280/415.1
5,397,147 A * 3/1995 Ducharme et al. ..... 280/415.1
5,433,356 A * 7/1995 Russell ..... 224/519
5,472,180 A * 12/1995 Bent ..... 269/99
5,489,110 A * 2/1996 Van Dusen ..... 280/415.1
D407,135 S * 3/1999 DeWitt ..... D22/113
6,085,954 A * 7/2000 Bloemer et al. ..... 224/509
6,443,345 B1 * 9/2002 Bloemer et al. ..... 224/519
D468,681 S * 1/2003 Rath ..... D12/400
6,637,738 B1 * 10/2003 Beaudet ..... 269/271
6,727,861 B2 * 4/2004 Antoine ..... 343/878

* cited by examiner

*Primary Examiner*—Shelley M. Self

(57) ABSTRACT

A portable work bench station having a base with a flat plate having four holes for securing to the work bench. The base has a longitudinal hollow receiver opening to the outside edge of the work bench. The portable work bench station has a receiver arm having outside dimensions smaller than the inside dimensions of the longitudinal hollow receiver so the receiver arm mates to and slidingly engages the hollow interior diameter of the longitudinal hollow receiver in telescopic fashion. The receiver arm has a mounting plate. The portable work bench station has an L-shaped tool mount which adjustably attaches to the mounting plate and to which is attached the tool to be used. The L-shaped tool mount has a horizontal wing and a vertical wing. The vertical wing is secured to the mounting plate and the horizontal wing has a plurality of apertures for receiving a fastening device such that a tool, vise, grinder, etc., can be securely fastened to the L-shaped tool mount.

3 Claims, 2 Drawing Sheets

FIGURE 3
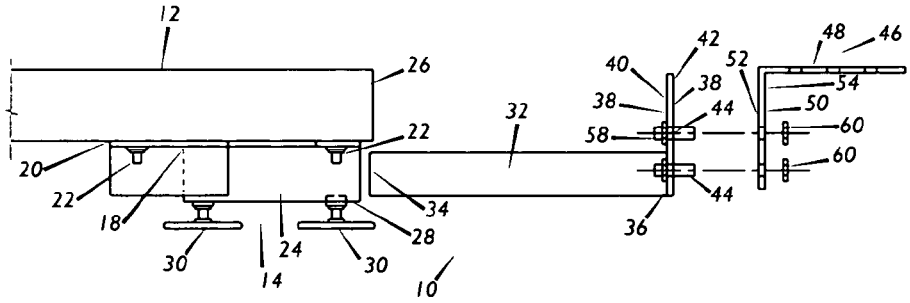
FIGURE 4
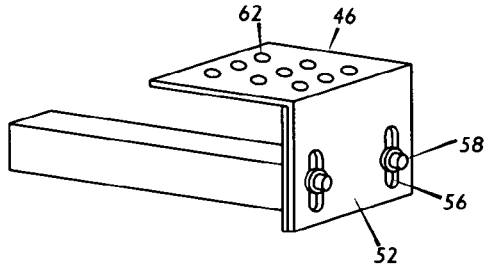
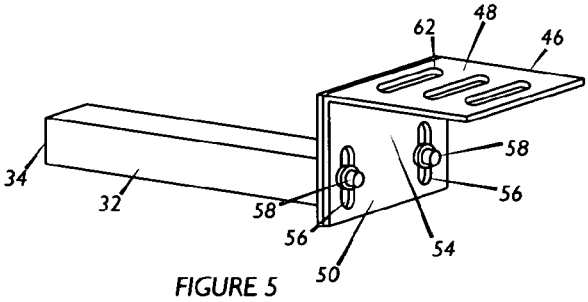
FIGURE 5
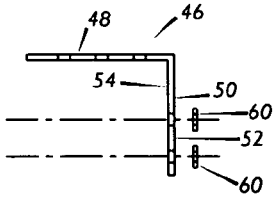
FIGURE 6
FIGURE 7
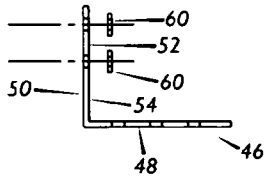
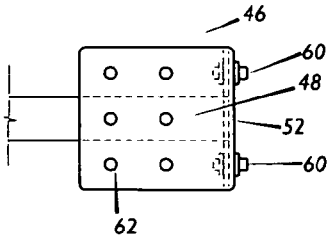
FIGURE 8
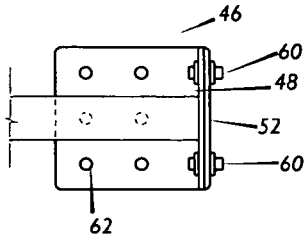
FIGURE 9

PORTABLE WORK BENCH STATION

TECHNICAL FIELD

The present invention relates to an apparatus for use with mounting tools to a work bench, and more particularly to an apparatus that can be used for temporarily extending and mounting tools to a work bench in adjustable fashion.

BACKGROUND INFORMATION

To utilize certain tools such as a drill, grinding wheel, or other tools requiring base stability, it is common to mount such tools directly to a work bench. Permanently mounted tools reduce the available work space, and thus the work utility, of a work bench. Permanently mounting tools on the work surface of the work bench can permanently disfigure the work surface of the work bench. A portable work bench station which could be temporarily, or permanently, secured to a work bench would provide additional work utility to the work bench, prevent reduction of available work space and avoid permanent disfiguring of the work surface of the work bench.

Portable work stations are known in the art. Such known apparatus may utilize vehicle mounted trailer hitch components. Other such apparatus may utilize a mounted vice for a base attachment. Still other such apparatus may utilize a single mount for attachment to the soffit of a building. And, still other such apparatus may involve a bench pin with an adjustable table platform.

U.S. Pat. No. 851,292 (Kapp) teaches a bench-pin in combination with a clamping means. The bench-pin comprises a clamp-bracket with a first right-angled extension and a second right-angled extension which forms the upper jaw of a clamp, a screw-threaded nut adapted to receive a clamp-screw by means of a pin, a ratchet-toothed head which swivels on the clamp-screw and which engages with the under side of a work-bench or table.

U.S. Pat. No. 5,082,037 (Hammons et al.) teaches a tool support assembly. Hammons et al.'s tool assembly discloses an apparatus for mounting tools and other devices which is capable of adjustment in both the vertical and horizontal directions relative to a box receiver mounted on the bumper of a vehicle. Hammons et al. comprises an L-shaped support section which at one slidingly engages and is fixed to a box receiver mounted on a vehicle bumper and at the other end, the L-shaped support section slidingly engages a second support member which has a mounting plate. The mounting plate has a number of holes or elongated slots to provide means for mounting tools, motors, vices and the like, to provide a secure mounting platform at remote locations.

U.S. Pat. No. 5,267,748 (Curran) teaches a vehicle tool platform apparatus and method for use with a vehicle having a rear tailgate or rear doors and a rear trailer hitch. Curran discloses a vehicle tool platform apparatus having a flat tool platform, an elongated angle support bar having one end secured to the bottom surface of the tool platform and the other end adapted to be received and secured in the rear trailer hitch. Curran shows the angle and length of the support rod is designed so that the plane of the tool platform is at a height generally level with the floor of the vehicle and sufficiently distant from the rear of the vehicle to enable opening of the tailgate or rear door.

U.S. Pat. No. 5,397,147 (Ducharme et al.) teaches a vehicular work table apparatus. Ducharme et al. discloses an apparatus coupleable to a hitch chassis of a vehicle comprising a pedestal formed of a rod including a base end and a support end, and a base segment and a support segment with the base end adapted to be coupled to a vehicle's hitch chassis. Ducharme et al. further discloses a plate coupled to the support end of a pedestal to define a table top.

U.S. Pat. No. 5,433,356 (Russell) teaches a vise adapted for mounting to a trailer receiver by its inner member. Russell discloses an engineer's vise having a fixed inner member with a stationary jaw and an elongate extension for inserting into and mounting to a trailer receiver. Russell further discloses that the vise has a moveable outer member and jaw operated by a threaded shaft and turned by a handle, which vise can be securely attached to the receiver by a pin in one of four positions.

U.S. Pat. No. 5,472,180 (Bent) teaches a log holder. Bent discloses an apparatus for holding firewood and dimension lumber including an upright member having a generally triangular shaped plate attached to one end, which plate has a plurality of steps each having a generally V-shaped portion facing downward and which engage the butt end of any diameter log placed on the holder. Bent further discloses a serrated plate attached under the triangular shaped plate used for securing the butt end. Bent further discloses a first end of a longitudinal member attached to an upright member under the serrated plate and extending away from the upright member, and a generally rectangular plate having a trough at the top attached to a second end of the upright member that is adapted for placing the holder into the receiver hitch of a vehicle.

U.S. Pat. No. Des. 407,135 (DeWitt) shows a clay pigeon launcher support.

U.S. Pat. No. D468,681 S (Rath) shows a utility mount for use with trailer hitch receiver.

U.S. Pat. No. 6,637,738 B1 (Beaudet) teaches a vise mountable tool holder bracket. Beaudet discloses a vice holdable mounting bracket for a bicycle stand, the bracket being adapted to be able to be held in a vise. Beaudet further discloses a mount which extends from the vise outwardly sufficiently to allow an object being held in a clamp mounted to the mounting bracket to be clear of the surface to which the vise is attached. Beuadet further discloses a stand having two angular pieces which intersect at right angles, each having a horizontal top surface and a vertical surface beneath, and which two angular pieces may have an "L" shaped cross section or a "T" shaped cross section.

U.S. Pat. No. 6,727,861 B2 (Antoine) teaches a satellite antenna mounting apparatus and method. Antoine discloses a mounting bracket having a single mount for attaching to the soffit of a building for adjustably carrying a satellite dish antenna, including a base having holes for receiving screws to secure the mount to structural members, a body including a bore for receiving an arm of the mounting bracket, which arm includes a plate on one end and which is positioned and secured within the mount.

None of the art as identified above, either individually or in combination, describes a portable work bench station in the manner provided for in the present invention. With the devices and methods known in the art, there remains a need to provide a portable work bench station which could be temporarily, or permanently, secured to a work bench, which would provide additional work utility to the work bench, which would prevent reduction of available work space, and which would avoid permanent disfiguring of the work surface of the work bench.

SUMMARY OF THE INVENTION

In view of the foregoing background, it is therefore an object of the present invention to provide a portable work bench station which could be temporarily or permanently secured to a work bench. It is a further object of the present invention to provide a portable work bench station which would provide additional work utility to the work bench. It is still a further object of the present invention to provide a portable work bench station which would prevent reduction of available work space. It is still a further object of the present invention to provide a portable work bench station which would avoid permanent disfiguring of the work surface of the work bench.

These and other objects, features, and advantages according to the present invention are provided by a portable work bench station having a base that attaches to the work bench, preferably, but not necessarily, on the underside of the work bench. The base has a flat plate which has a first flat surface and a second flat surface. The flat plate has a plurality of four holes drilled through the first and second flat surfaces for placement of screws or other securing means of attachment of the base to the work bench. The base further has a longitudinal hollow receiver, which longitudinal hollow receiver attaches and is secured to the base on the second flat surface and which opens perpendicularly to the outside edge of the work bench when the base of the portable work bench station is secured to the work bench. The longitudinal hollow receiver has a plurality of two threaded holes drilled through a side, which threaded holes have a plurality of two correspondingly threaded bolts, with each threaded hole receiving a threaded bolt. The portable work bench station further has a receiver arm, which receiver arm has a first end and a second end, and the outside dimensions of which receiver arm are smaller than the inside dimensions of the longitudinal hollow receiver such that when the two are engaged, there is a snug fit. The first end of the receiver arm mates to and slidingly engages the hollow interior diameter of the longitudinal hollow receiver of the base in telescopic fashion and is releasably secured therein by the plurality of two threaded bolts. Ideally, the longitudinal hollow receiver and the receiver arm will be square-shaped, but can be triangular, circular, or other appropriately shaped so long as the receiver arm is able to mate to and slidingly engage the hollow interior diameter of the longitudinal hollow receiver with minimum or no rotational movement therein when secured.

The second end of the receiver arm has a mounting plate attached in perpendicular manner, perpendicular in that when the base is attached to the work bench by securing the first flat surface of the flat plate of the base to the work bench and securing the receiver arm with the attached mounting plate in the longitudinal hollow receiver, the mounting plate is also perpendicular to the surface of the work bench. The mounting plate has a first flat side, a second flat side, and a plurality of two holes drilled between and through the first and second flat sides.

The portable work bench station has an L-shaped tool mount which adjustably attaches to the mounting plate and to which is attached the tool to be used. The L-shaped tool mount has a horizontal wing and a vertical wing, such wings being relative to the work surface of the work bench when the base is attached to the work bench by securing the first flat surface of the flat plate of the base to the work bench, securing the receiver arm with the attached mounting plate in the longitudinal hollow receiver, and attaching the vertical wing of the L-shaped tool mount to the mounting plate. The vertical wing of the L-shaped tool mount has a first flat side, a second flat side, and a plurality of two elongated slots cut between and through the first and second flat sides. The plurality of two elongated slots correspond to the plurality of two holes drilled between and through the first and second flat sides of the mounting plate, and the vertical wing of the L-shaped tool mount is secured to the mounting plate by a plurality of two threaded bolts passing through the plurality of two holes of the mounting plate and the plurality of two elongated slots of the vertical wing and being secured by a plurality of two correspondingly threaded nuts. The horizontal wing of the L-shaped tool mount has a plurality of apertures which may be in the form of holes, elongated slots or in any other configuration for the purpose of receiving a bolt or other fastening device such that a tool, vise, grinder, etc., can be securely fastened to the horizontal wing of the L-shaped tool mount.

These and other objects of the present invention will become apparent from a reading of the following specification taken in conjunction with the enclosed drawings.

BRIEF DESCRIPTION OF THE DRAWINGS

The above and other features and aspects of the present invention will become more apparent upon reading the following detailed description in conjunction with the accompanying drawings, in which:

FIG. 3 shows a side perspective view of the receiver arm and an L-shaped tool mount of a portable work bench station positioned for attachment to the longitudinal hollow receiver of the base;

FIG. 4 shows a perspective view of the receiver arm and one embodiment of an L-shaped tool mount of a portable work bench station having elongated slots for the purpose of receiving a bolt or other fastening device for securely fastening a tool, vise, grinder, thereto;

FIG. 5. shows a perspective view of the receiver arm and one embodiment of an L-shaped tool mount of a portable work bench station having a plurality of holes for the purpose of receiving a bolt or other fastening device for securely fastening a tool, vise, grinder, thereto;

FIG. 6. shows a perspective view of the L-shaped tool mount of a portable work bench station mountable on the receiver arm with the horizontal wing in an upper position towards the work bench;

FIG. 7 shows a perspective view of the L-shaped tool mount of a portable work bench station mountable on the receiver arm with the horizontal wing in a lower position away from the work bench;

FIG. 8 shows a top perspective view of the L-shaped tool mount having a plurality of holes of a portable work bench station attached to the receiver arm with the horizontal wing in an upper position towards the work bench;

FIG. 9 shows a top perspective view of the L-shaped tool mount having a plurality of holes of a portable work bench station attached to the receiver arm with the horizontal wing in an lower position towards the work bench;

DESCRIPTION OF PREFERRED EMBODIMENT

Figure 1:
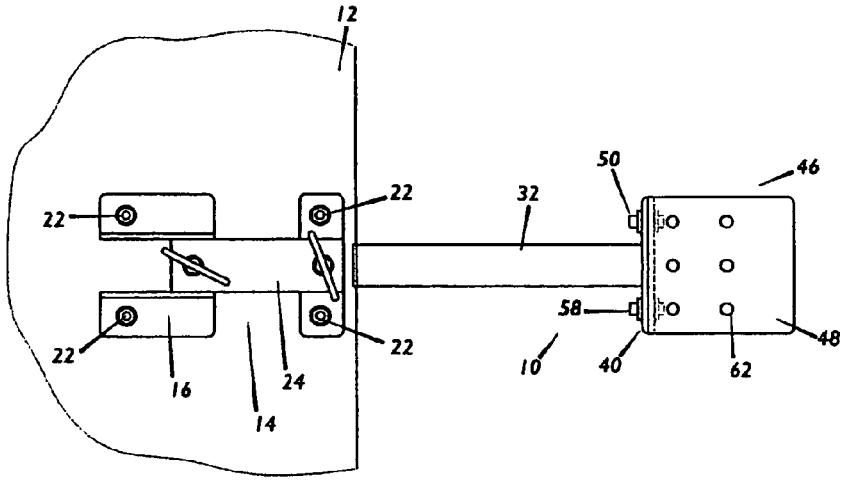
FIG. 1 shows a bottom perspective view of a portable work bench station in accordance with the principles of the present invention in relative position for attachment to the underside of a work bench.
Figure 2:
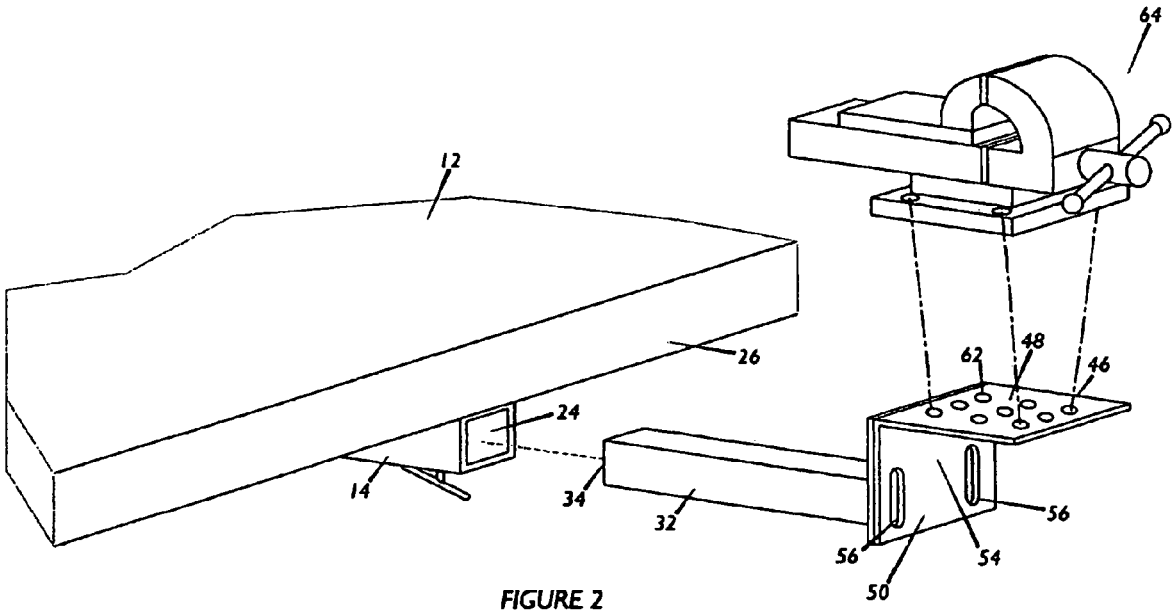
FIG. 2 shows a top perspective view of the receiver arm with an attached L-shaped tool mount of a portable work bench station positioned for attachment to the longitudinal hollow receiver of the base.

FIGS. 1-4 show a portable work bench station 10 relatively placed for attachment to a work bench 12. The portable work bench station 10 has a base 14 that attaches to the work bench 12, preferably, but not necessarily, on the underside of the work bench 12. The base 14 has a flat plate 16 which has a first flat surface 18 and a second flat surface 20. The flat plate 16 has a plurality of four holes 22 drilled through the first and second flat surfaces 18,20 for placement of screws or other securing means of attachment of the base 14 to the work bench 12. The base 14 further has a longitudinal hollow receiver 24, which longitudinal hollow receiver 24 attaches and is secured to the base 14 on the second flat surface 20 and which opens perpendicularly to the outside edge 26 of the work bench 12 when the base 14 of the portable work bench station 10 is secured to the work bench 12. The longitudinal hollow receiver 24 has a plurality of two threaded holes 28 drilled through a side, which threaded holes 28 have a plurality of two correspondingly threaded bolts 30, with each threaded hole 28 receiving a threaded bolt 30. The portable work bench station 10 further has a receiver arm 32, which receiver arm 32 has a first end 34 and a second end 36, and the outside dimensions of which receiver arm 32 are smaller than the inside dimensions of the longitudinal hollow receiver 24 such that when the two are engaged, there is a snug fit. The first end 34 of the receiver arm 32 mates to and slidingly engages the hollow interior diameter of the longitudinal hollow receiver 24 of the base in telescopic fashion and is releasably secured therein by the plurality of two threaded bolts 30. Ideally, the longitudinal hollow receiver 24 and the receiver arm 32 will be square-shaped, but can be triangular, circular, or other appropriately shaped so long as the receiver arm 32 is able to mate to and slidingly engage the hollow interior diameter of the longitudinal hollow receiver 24 with minimum or no rotational movement therein when secured.

The second end 36 of the receiver arm 32 has a mounting plate 38 attached in perpendicular manner, perpendicular in that when the base 14 is attached to the work bench 12 by securing the first flat surface 18 of the flat plate 16 of the base 14 to the work bench 12 and securing the receiver arm 32 with the attached mounting plate 38 in the longitudinal hollow receiver 24, the mounting plate 38 is also perpendicular to the surface of the work bench 12. The mounting plate 38 has a first flat side 40, a second flat side 42, and a plurality of two holes 44 drilled between and through the first and second flat sides 40,42.

The portable work bench station 10 has an L-shaped tool mount 46 which adjustably attaches to the mounting plate 38 and to which is attached the tool 64 to be used. The L-shaped tool mount 46 has a horizontal wing 48 and a vertical wing 50, such wings 48,50 being relative to the work surface of the work bench 12 when the when the base 14 is attached to the work bench 12 by securing the first flat surface 18 of the flat plate 16 of the base 14 to the work bench 12, securing the receiver arm 32 with the attached mounting plate 38 in the longitudinal hollow receiver 24, and attaching the vertical wing 50 of the L-shaped tool mount 46 to the mounting plate 38. The vertical wing 50 of the L-shaped tool mount 46 has a first flat side 52, a second flat side 54, and a plurality of two elongated slots 56 cut between and through the first and second flat sides 52,54. The plurality of two elongated slots 56 correspond to the plurality of two holes 44 drilled between and through the first and second flat sides 40,42 of the mounting plate 38, and the vertical wing 50 of the L-shaped tool mount 46 is secured to the mounting plate 38 by a plurality of two threaded bolts 58 passing through the plurality of two holes 44 of the mounting plate 38 and the plurality of two elongated slots 56 of the vertical wing 50 and being secured by a plurality of two correspondingly threaded nuts 60. The horizontal wing 48 of the L-shaped tool mount 46 has a plurality of apertures 62 which may be in the form of holes, elongated slots or in any other configuration for the purpose of receiving a bolt or other fastening device such that a tool 64, vise, grinder, etc., can be securely fastened to the horizontal wing 48 of the L-shaped tool mount 46.

In use, a work bench can be a flat surface supported by legs. Often, the underside of the flat surface is also flat. The first flat surface 18 of the flat plate 16 of the base 14 of the portable work bench station 10 is attached to the work bench 12, preferably, but not necessarily, on the underside of the work bench 12 by means of the plurality of four holes 22 drilled through the first and second flat surfaces 18,20 for placement of screws or other securing means of attachment of the base 14 to the work bench 12. With the base 14 so attached, the longitudinal hollow receiver 24 opens perpendicularly to the outside edge 26 of the work bench 12. The first end 34 of the receiver arm 32 mates to and slidingly engages the hollow interior diameter of the longitudinal hollow receiver 24 of the base in telescopic fashion and is releasably secured therein by the plurality of two threaded bolts 30 rotationally tightened in the plurality of two threaded holes 28 drilled through a side of the longitudinal hollow receiver 24, which method of securing of the receiver arm 32 in the longitudinal hollow receiver 24 allows for inward and outward adjustment of the receiver arm 32. The L-shaped tool mount 46 is then adjustably attached to the mounting plate 38 by attaching the vertical wing 50 of the L-shaped tool mount 46 to the mounting plate 38 by the plurality of two threaded bolts 58 passing through the plurality of two holes 44 of the mounting plate 38 and the plurality of two elongated slots 56 of the vertical wing 50 and being secured by a plurality of two correspondingly threaded nuts 60. Such attachment of the L-shaped tool mount 46 to the mounting plate 38 allows for adjustment upwardly and downwardly relative to the work bench 10 surface. The tool 64 to be used is then attached to the horizontal wing 48 of the L-shaped tool mount 46 placing the tool on the upside surface of the horizontal wing 48 of the L-shaped tool mount 46 and placing bolts or other fastening devices through attachment openings in the base of the tool 64 and the plurality of apertures 62 in the horizontal wing 48 of the L-shaped tool mount 46.

Various changes and departures may be made to the invention without departing from the spirit and scope thereof. Accordingly, it is not intended that the invention be limited to that specifically described in the specification or as illustrated in the drawings but only as set forth in the claims. From the drawings and above-description, it is apparent that a portable work station constructed in accordance with the invention herein provides desirable features and advantages. While the form of the invention herein described constitutes a preferred embodiment of the invention, it is to be understood that the invention herein is capable of further modification, and this application is intended to cover any variations, uses, or adaption of the invention herein, following in general the principles of the invention herein and include such departures from the present disclosure as to come within knowledge or customary practice in the art to which the invention herein pertains, and as may be applied to the essential features hereinbefore set forth and falling within the scope of the invention herein or the limits of the appended claims.

What is claimed is:

1. A portable work bench station for attachment to a work bench comprising:

a base that attaches to the work bench, said base having a flat plate which has a first flat surface and a second flat surface;

said flat plate having a plurality of four holes, said plurality of four holes being drilled through the first and second flat surfaces for placement of screws or other securing means of attachment of the base to the work bench;

said base having a longitudinal hollow receiver, said longitudinal hollow receiver attaching and being secured to the base on the second flat surface;

said longitudinal hollow receiver having a hollow interior diameter and a plurality of two threaded holes, said plurality of two threaded holes having a plurality of two correspondingly threaded bolts;

a receiver arm, said receiver arm having a first end and a second end;

said first end of said receiver arm mating to and slidingly engaging said hollow interior diameter of said longitudinal hollow receiver of said base in telescopic fashion and being releasably secured therein by said plurality of two threaded bolts;

said second end of the receiver arm having a mounting plate;

said mounting plate having a first flat side, a second flat side, and a plurality of two holes drilled between and through said first flat side and said second flat side;

an L-shaped tool mount, said L-shaped tool mount being attached to said mounting plate, and to which is attached a tool;

said L-shaped tool mount having a horizontal wing and a vertical wing;

said vertical wing of said L-shaped tool mount attaching to said mounting plate;

said vertical wing of said L-shaped tool mount having a first flat side, a second flat side, and a plurality of two elongated slots cut between and through said first flat side and said second flat side;

said plurality of two elongated slots corresponding to said plurality of two holes drilled between and through said first flat side and said second flat side of said mounting plate;

said vertical wing of said L-shaped tool mount being secured to said mounting plate by a plurality of two threaded bolts passing through said plurality of two holes of the mounting plate and said plurality of two elongated slots of said vertical wing and being secured by a plurality of two correspondingly threaded nuts; and, said horizontal wing of said L-shaped tool mount having a plurality of apertures, said plurality of apertures each receiving a bolt or other fastening device to securely fasten said tool to said horizontal wing of said L-shaped tool mount.

2. A portable work bench station for attachment to a work bench comprising:

a base that attaches to the work bench, said base having a flat plate which has a first flat surface and a second flat surface;

said flat plate having a plurality of four holes, said plurality of four holes being drilled through the first and second flat surfaces for placement of screws or other securing means of attachment of the base to the work bench;

said base having a longitudinal hollow receiver, said longitudinal hollow receiver attaching and being secured to the base on the second flat surface;

said longitudinal hollow receiver having a hollow interior diameter and a plurality of two threaded holes, said plurality of two threaded holes having a plurality of two correspondingly threaded bolts;

a receiver arm, said receiver arm having a first end and a second end;

said first end of said receiver arm mating to and slidingly engaging said hollow interior diameter of said longitudinal hollow receiver of said base in telescopic fashion and being releasably secured therein by said plurality of two threaded bolts;

said second end of the receiver arm having a mounting plate;

said mounting plate having a first flat side, a second flat side, and a plurality of two holes drilled between and through said first flat side and said second flat side;

an L-shaped tool mount, said L-shaped tool mount being attached to said mounting plate, and to which is attached a tool;

said L-shaped tool mount having a horizontal wing and a vertical wing;

said vertical wing of said L-shaped tool mount attaching to said mounting plate;

said vertical wing of said L-shaped tool mount having a first flat side, a second flat side, and a plurality of two elongated slots cut between and through said first flat side and said second flat side;

said plurality of two elongated slots corresponding to said plurality of two holes drilled between and through said first flat side and said second flat side of said mounting plate;

said vertical wing of said L-shaped tool mount being secured to said mounting plate by a plurality of two threaded bolts passing through said plurality of two holes of the mounting plate and said plurality of two elongated slots of said vertical wing and being secured by a plurality of two correspondingly threaded nuts; and, said horizontal wing of said L-shaped tool mount having a plurality of apertures, said plurality of apertures being a plurality of holes drilled through said horizontal wing and receiving bolts or other fastening devices to securely fasten said tool to said horizontal wing of said L-shaped tool mount.

3. A portable work bench station for attachment to a work bench comprising:

a base that attaches to the work bench, said base having a flat plate which has a first flat surface and a second flat surface;

said flat plate having a plurality of four holes, said plurality of four holes being drilled through the first and second flat surfaces for placement of screws or other securing means of attachment of the base to the work bench;

said base having a longitudinal hollow receiver, said longitudinal hollow receiver attaching and being secured to the base on the second flat surface;

said longitudinal hollow receiver having a hollow interior diameter and a plurality of two threaded holes, said plurality of two threaded holes having a plurality of two correspondingly threaded bolts;

a receiver arm, said receiver arm having a first end and a second end;

said first end of said receiver arm mating to and slidingly engaging said hollow interior diameter of said longitudinal hollow receiver of said base in telescopic fashion and being releasably secured therein by said plurality of two threaded bolts;

said second end of the receiver arm having a mounting plate;

said mounting plate having a first flat side, a second flat side, and a plurality of two holes drilled between and through said first flat side and said second flat side;

an L-shaped tool mount, said L-shaped tool mount being attached to said mounting plate, and to which is attached a tool;

said L-shaped tool mount having a horizontal wing and a vertical wing;

said vertical wing of said L-shaped tool mount attaching to said mounting plate;

said vertical wing of said L-shaped tool mount having a first flat side, a second flat side, and a plurality of two elongated slots cut between and through said first flat side and said second flat side;

said plurality of two elongated slots corresponding to said plurality of two holes drilled between and through said first flat side and said second flat side of said mounting plate;

said vertical wing of said L-shaped tool mount being secured to said mounting plate by a plurality of two threaded bolts passing through said plurality of two holes of the mounting plate and said plurality of two elongated slots of said vertical wing and being secured by a plurality of two correspondingly threaded nuts; and, said horizontal wing of said L-shaped tool mount having a plurality of apertures, said plurality of apertures being a plurality of elongated slots through said horizontal wing and receiving bolts or other fastening devices to securely fasten said tool to said horizontal wing of said L-shaped tool mount.

* * * * *